US006234605B1

(12) United States Patent
Hilton

(10) Patent No.: US 6,234,605 B1
(45) **Date of Patent: *May 22, 2001**

(54) MULTIPLE RESOLUTION PAGEWIDTH INK JET PRINTER INCLUDING A POSITIONABLE PAGEWIDTH PRINTBEAR

(75) Inventor: Brian S. Hilton, Rochester, NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,270

(22) Filed: Jan. 8, 1998

(51) Int. Cl.[7] ..... B41J 2/155
(52) U.S. Cl. ..... 347/42; 347/13
(58) Field of Search ..... 347/40, 42, 5, 347/13, 11, 130, 12, 15, 43

(56) References Cited

U.S. PATENT DOCUMENTS

| | | | | |
|---|---|---|---|---|
| 4,009,332 | * | 2/1977 | Van Hook | 346/75 |
| 4,602,262 | * | 7/1986 | Milligan et al. | 346/160 |
| 4,748,453 | | 5/1988 | Lin et al. | 347/41 |
| 5,057,854 | | 10/1991 | Pond et al. | 347/42 |
| 5,160,945 | | 11/1992 | Drake | 347/42 |
| 5,216,442 | | 6/1993 | Parks et al. | 346/134 |
| 5,300,957 | | 4/1994 | Burke | 347/41 |
| 5,396,274 | * | 3/1995 | Ortquist et al. | 347/5 |
| 5,541,625 | | 7/1996 | Holstun et al. | 347/5 |
| 5,572,244 | | 11/1996 | Drake et al. | 347/42 |
| 5,600,351 | | 2/1997 | Holstun et al. | 347/40 |
| 5,710,582 | * | 1/1998 | Hawkins et al. | 347/42 |
| 5,745,131 | * | 4/1998 | Kneezel et al. | 347/40 |
| 5,757,407 | * | 5/1998 | Rezanka | 347/102 |
| 5,801,722 | * | 9/1998 | Ueda et al. | 347/14 |
| 5,880,757 | * | 3/1999 | Ta | 347/42 |
| 5,900,891 | * | 5/1999 | Shimoda | 347/43 |

FOREIGN PATENT DOCUMENTS

| | | | | |
|---|---|---|---|---|
| 406071947 | * | 3/1994 | (JP) | 347/42 |

* cited by examiner

*Primary Examiner*—N. Le
*Assistant Examiner*—Lamson D. Nguyen
(74) *Attorney, Agent, or Firm*—Robert A. Chittum; Linda M. Robb

(57) ABSTRACT

A liquid ink printer, depositing ink drops to form an image, in multiple printing resolutions, on a recording medium moving along a recording medium path. The liquid ink printer includes a pagewidth printbar, including an array of ink ejecting nozzles spaced at a predetermined resolution, aligned substantially perpendicular to the recording medium path, to eject the ink drops on the recording medium during movement of the recording medium along the recording medium path, a positioning device, coupled to the pagewidth printbar, to position the printbar at a plurality of discrete locations, and a controller, coupled to the printbar and to the positioning device, to cause the positioning device to position the printbar at the plurality of discrete locations as a function of the predetermined resolution.

22 Claims, 3 Drawing Sheets

MULTIPLE RESOLUTION PAGEWIDTH INK JET PRINTER INCLUDING A POSITIONABLE PAGEWIDTH PRINTBEAR

RELATED APPLICATIONS

Cross-reference is made to patent application Ser. No. 09/004,826, entitled "An Inkjet Marking Device Including a Positionable Printbar to Improve Image Output", to William G. Hawkins et al. filed concurrently herewith, herein incorporated by reference.

FIELD OF THE INVENTION

This invention relates generally an ink jet printer and more particularly to a multiple resolution pagewidth ink jet printer including a pagewidth printbar.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a drop or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (having a height equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Various printers and methods are illustrated and described in the following disclosures which may be relevant to certain aspects of the present invention.

In U.S. Pat. No. 4,748,453 to Lin et al., a method of depositing spots of liquid ink on a substrate is described. A line of information is printed in at least two passes so as to deposit spots of liquid ink on selected pixel centers in a checkerboard pattern wherein only diagonally adjacent pixel areas are deposited in the same pass.

U.S. Pat. No. 5,057,854 to Pond et al. describes modular partial bars and full width array printheads fabricated from modular partial bars. The modular partial bars include a substrate bar having a length and a plurality of printhead subunits attached to only one side of the substrate bar. The modular partial bars are used as building blocks to form full width staggered array printheads.

U.S. Pat. No. 5,160,945 to Drake describes a page width thermal ink jet printhead for an ink jet printer. The printhead is of the type assembled from fully functional roof shooter type printhead subunits.

U.S. Pat. No. 5,216,442 to Parks et al. describes an ink jet printer having a platen with a planar surface sized to hold a sheet. The platen is movably mounted for linear reciprocal movement between a sheet receiving position and a sheet releasing position.

U.S. Pat. No. 5,300,957 to Burke describes a method and apparatus for high speed interlaced printing in the direction of printhead scanning. A cylindrical drum is rotatable about a drum axis for supporting a print medium during printing. The drum is rotated about the drum axis at a predetermined speed such that alternate image-element locations are addressed by each printing element during each rotation of the drum at the predetermined rate. The drum rotates two revolutions at each printhead location along with access and all image element locations are addressed.

U.S. Pat. No. 5,572,244 to Drake et al. describes a large array or page width printhead fabricated from printhead elements or subunits having adhesivefree butting edges. Each of the printhead elements includes a heater element and a channel element bonded together by an adhesive such as an epoxy.

U.S. Pat. No. 5,541,625 to Holstun et al. and U.S. Pat. No. 5,600,351 to Holstun et al. describe an ink jet printer system which fires smaller ink droplet in a single pass print mode to achieve a print resolution of 600 dpi in the carriage scan axis along with 300 dpi resolution in the media advance axis.

SUMMARY OF THE INVENTION

In accordance with one aspect of the present invention, there is provided a liquid ink printer, depositing ink drops to form an image, in multiple printing resolutions, on a recording medium moving along a recording medium path. The printer includes a pagewidth printbar, including an array of ink ejecting nozzles spaced at a predetermined resolution, aligned substantially perpendicular to the recording medium path, to eject the ink drops on the recording medium during movement of the recording medium along the recording medium path, a positioning device, coupled to the pagewidth printbar, to position the printbar at a plurality of discrete locations, and a controller, coupled to the printbar and to the positioning device, to cause the positioning device to position the printbar at the plurality of discrete locations as a function of the predetermined resolution.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
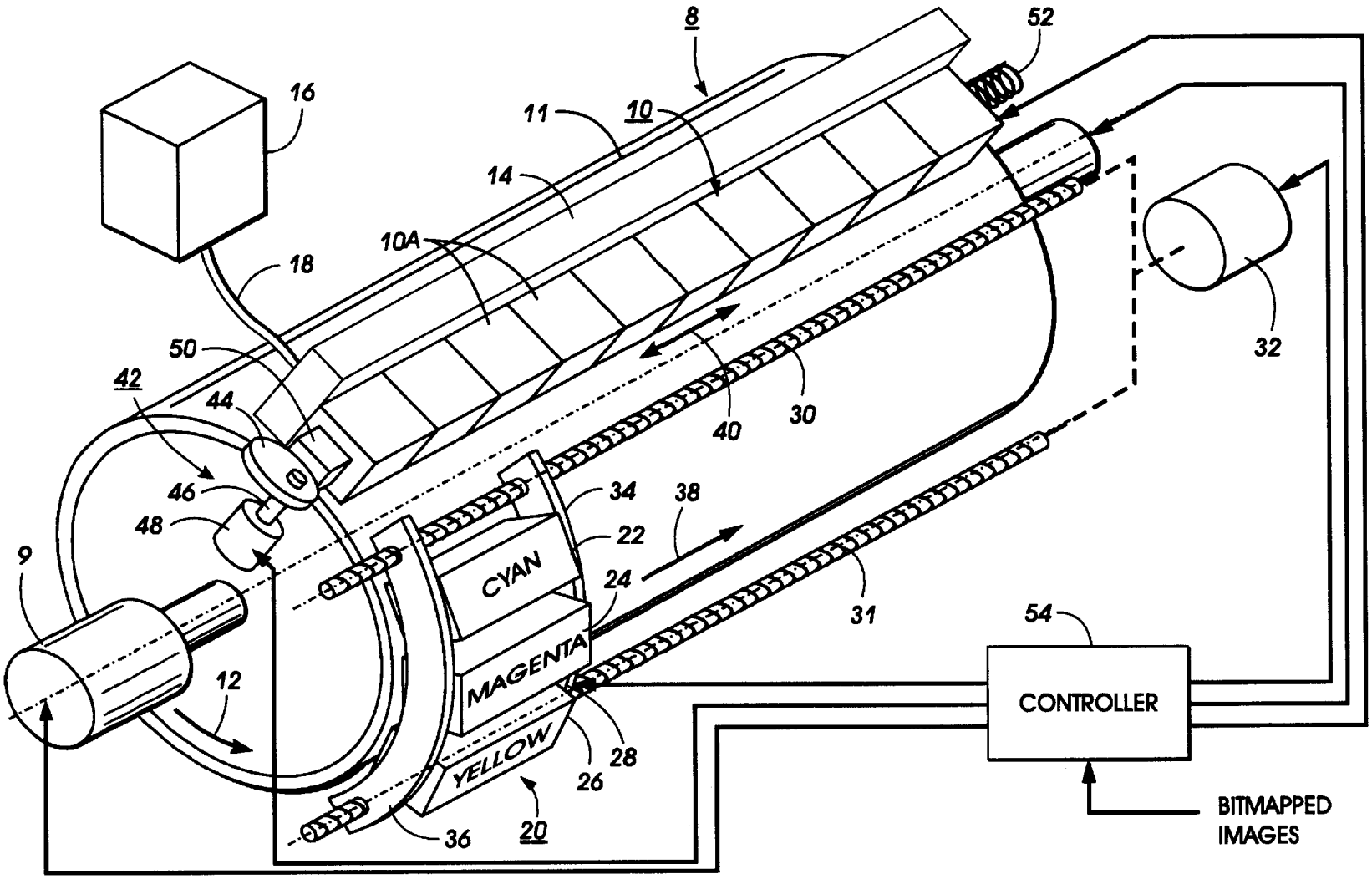
FIG. 1 is a perspective view of an ink jet printer of the present invention.

FIG. 1 illustrates one embodiment of the present invention of a ink jet printer 8 including a page width or large array black print bar 10 positioned to deposit ink on a curved recording medium placed on a rotating drum 11 which is rotated by a multiple speed motor 9 and which rotates the drum 11 in the direction of an arrow 12 at selected different speeds. The print bar 10 has been assembled from a plurality of modules or printhead dies 10A which are butted together to form an extended width array according to the techniques described, for example, in U.S. Pat. No. 5,221,397 the contents of which are hereby incorporated by reference. In this example, the print bar 10 includes 7,200 nozzles or jets. As described in the '397 patent, the printhead dies 10A are formed by mating a channel die containing arrays or recesses that are used as channels for delivering ink and associated ink reservoirs and a heater die containing heater elements and the appropriate addressing circuitry. The mated channel die and heater die form the printhead die which are butted together to form the print bar. The heater elements are selectively energized to heat the ink contained within a channel to expel an ink droplet from the associated nozzle. The ink channels are coupled into a common ink manifold 14 mounted along and attached to the print bar 10 in sealed communication with the ink inlets of the channel dies through aligned openings. The manifold 14 is supplied with the appropriate ink, black in this example, from an ink container 16 through a flexible tubing 18 attached thereto.

In addition to the print bar 10 printing black ink, a color printhead assembly 20 includes a plurality of ink jet printheads 22, 24, and 26, each printing a respective color, for instance cyan, magenta, and yellow. The appropriate ink can be supplied to the associated printhead by inclusion in an attached printhead ink tank coupled to the printheads themselves or by ink containers attached to the printheads through flexible tubing (not shown) such as illustrated by the ink container 16. The assembly 20 is mounted on a translatable carriage 28 which is driven by lead screws 30 and 31 by a drive motor 32. The carriage 28 includes curved frame members 34 and 36, portions of which include threaded apertures through which the lead screws 30 and 31 are threaded. The carriage 28 moves in a direction 38. The printheads 22, 24 and 26 are conventional in construction and can be fabricated, for example, as illustrated in U.S. Pat. Nos. Re. 32,572 and 4,774,530 both of which are incorporated by reference.

While the printer of FIG. 1 can be operated either as a black only printer by printing with the print bar 10 only or as a color printer by using the assembly 20 to deposit colored inks or a combination of the two, the printer of FIG. 1 also includes an additional mechanism for improving the image output of the printer 10 by the use of a multiple pass printing technique whereby the print bar 10 is moved in discrete steps to provide multiple printing resolutions with a fixed resolution pagewidth printbar.

To provide multiple printing resolutions, the print bar 10 is moved in a direction 40 by a positioning device 42 which changes the position of the print bar 10 during each rotation of the drum 11. In one embodiment, the positioning device 42 includes a cam 44 rotating upon a spindle 46 which is driven by a motor 48. The cam 44 is eccentrically shaped and has an axis of rotation which is offset from the center of the cam such that when the cam 44 rotates upon a butting member 50, the print bar moves in the direction 40 an amount determined by the shape of the cam as well as the amount of rotation determined by the motor 48. A spring bias system 52 is located at the opposite end of the print bar such that the print bar 10 is maintained in a stable position during printing.

To print an image, a controller 54 receives bit map images from a print driver which is either resident in the printer or is resident in an image generating device such as a personal computer, or a combination of the two. The bit mapped images are manipulated by the controller 54 such that the appropriate signals are transmitted to the print bar 10 as well as the printhead assembly 20. The drive signals generated by the controller 54 are conventionally applied via wire bonds to drive circuitry and logic on each of the printhead dies 10A and each of the printheads 22, 24, and 26. Signals include pulsing signals which are applied to the heat generating resistors or transducers formed in the heater dies. The controller 54 may take the form of a microcomputer including a central processing unit, a read-only memory for storing complete programs and a random access memory. The controller 42 also controls other machine functions such as rotation of the drum 11, movement of the scanning carriage 20 by control of the motor 32 as well as movement of the print bar 10 in discrete locations determined by the rotation of the cam 44 under control of the motor 48.

Figure 2:
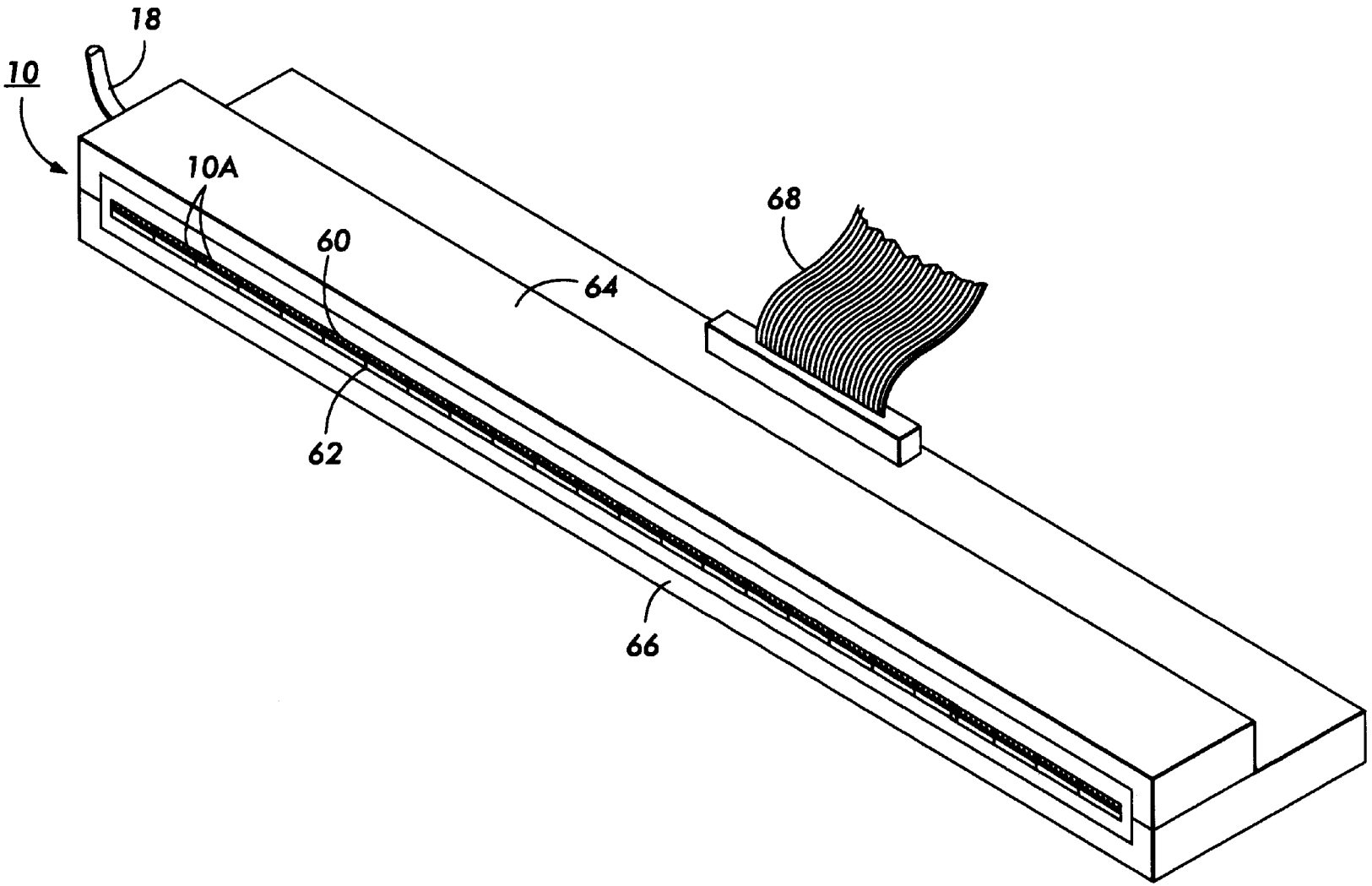
FIG. 2 is a perspective view of an ink jet printbar.

FIG. 2 illustrates a more detailed illustration of the print bar 10. As illustrated, the print bar 10 includes multiple printhead dies 10A as previously described each shown to include, for purposes of illustration, four printhead nozzles 60 having a fixed resolution, such as 400 nozzles per inch. Each of the printhead dies 10A is butted to an adjacent printhead die and a printhead die joint 62 is located therebetween. The printhead dies are mounted between a first substrate 64 and a second substrate 66. Other configurations are also possible. A ribbon cable 68 is coupled to one of the substrates 66 and provides the signals to the various printhead dies received from the controller 54 as previously described.

Figure 3:
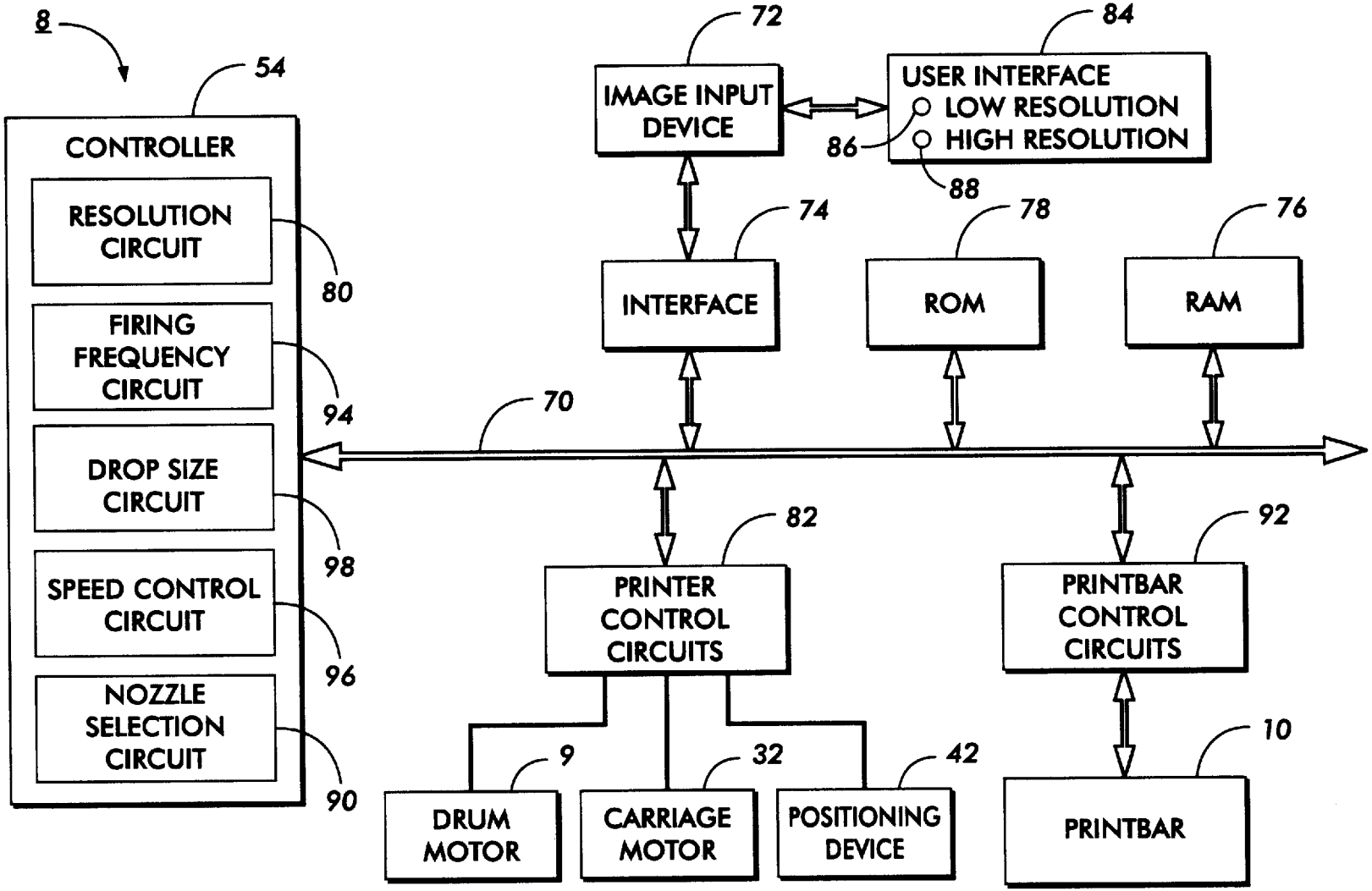
FIG. 3 is a schematic circuit diagram of a control system of the present invention.

FIG. 3 illustrates the controller 54 of the present invention including the connection thereof to a bus 70 for transmission of image information and/or control signals between a plurality of printer devices and an image input device 72. The image input device 72 includes a number of known image generators which generate image information in the form of various image description languages such as the known page description language (PDL) and Postscript. The image input device could, for instance, include a personal computer, a computer work station, a scanner, or other known image input devices. The input image is transferred over a connecting bus to an interface 74 of the printer which provides for a compatible interchange of the information generated by the image input device 72 to the printer. The interface 74 is connected to the bus 70 and transmits information over the bus 70 to the controller 54 or to a random access memory (RAM) 76 under the direction of the controller 54 for storage of image information. The printer in addition, includes a read only memory (ROM) 78 which includes sufficient memory for the storage of pre-determined operating system or controlling programs such as is known by those skilled in the art. The ROM 78 is also coupled to the bus 70.

The controller 54 includes a plurality of circuits which enable the printer 8 to print at a resolution which is greater than the fixed printhead nozzle resolution of the printhead 10. As can be seen in FIG. 2, each of the printhead dies 10A includes a plurality of nozzles 60 which are spaced at a pre-determined resolution. In one example of the printhead dies 10A, the printhead nozzles 60 are spaced at a spacing of 400 nozzles per inch. Other nozzles spacings are, of course, possible and can include 300 nozzles, 600 nozzles per inch or even greater. For the present discussion of the increased resolution pagewidth printhead of the present invention, however, an exemplary nozzle spacing of 400 nozzles per inch is considered.

There exists an increasing demand for greater print quality in liquid ink printers and, in particular, increased resolution of the output images. Increased resolution, however, has been limited by the manufacturing processes which are used to create the large number of ink jet nozzles and channels carrying the ink to the nozzles. Consequently, high resolution ink jet print bars having increased resolution resulting from more tightly packed nozzles is problematic due not only to the difficulty of manufacturing such nozzles but also the difficulty in reliably maintaining the operation of such a large number of extremely small ink jet nozzles. The present invention, therefore, proposes using a positioning device to position the print bar 10 at a plurality of discrete locations wherein the distance between two of the discrete locations is less than the distance between adjacent nozzles of the print bar. In one instance of the present invention, the positioning device moves the print bar a distance of one-half the distance between adjacent printhead nozzles. This amount of movement doubles the printing resolution in the direction 40 with a printbar having one-half the image resolution.

To provide for the printing of images having selectable resolutions, the controller 54 includes a resolution circuit 80 which provides for increased resolution of the print bar by transmitting a signal over the bus 70 to a printer control circuit 82 coupled to the positioning device 42. The resolution circuit 80 generates an increased resolution signal in response to an input from the image input device 72, which may be included in the transmitted description language of the image, or in response to a selection by a user through a user interface 84 having user selectable resolutions such as a low resolution selection 86 and a high resolution selection 88. The user interface 84 appears on a display device, for instance a cathode ray tube or liquid crystal display, of the image input device 72 and includes such known user interfaces where selections of two or more document resolutions can selected by a user. Once the resolution has been selected either through the user interface 84 or by the generation of image signals through the image input device 72, the controller receiving the information over the bus 70 causes the resolution circuit 80 to generate the necessary signals to cause the positioning device 42 to move to the appropriate locations.

For each movement of the print bar 10 under control of the positioning device 42, the drum 11 makes a single revolution such that the recording medium can pass by the print bar in its entirety. After a first pass is made, the print bar 10 moves to a second location a distance of one-half the distance between adjacent nozzles of the print bar to print during a second revolution of the drum 11 to complete an image.

Depending on the amount of ink which is to be deposited by the print bar 10 to complete an image, two revolutions of the drum 11 may be sufficient to complete an image. If, however, a large amount of ink must be deposited to complete an image, the controller 54 includes a nozzle selection circuit 90 which transmits a signal to the print bar 10 through the bus 70 and through a print bar control circuit 92. The print bar control circuits 92 typically reside on a substrate of the print bar 10. The nozzle selection circuit 90 transmits the signal to provide for alternating ones of the plurality of ink ejection nozzles to eject ink during formation of the image. To complete an image having a resolution of 800 drops per inch, four passes of the recording medium past the print bar 10 would be necessary when printing alternating ones of the ink ejecting nozzles. Checkerboarding techniques such as described in U.S. Pat. No. 4,748,453 to Lin et al. can be used, which is herein incorporated by reference. In this example, the drum rotates four times, wherein for each rotation, the print bar is moved at least a distance of one-half of the nozzle spacing.

To achieve the same printing throughput in each of the described printing resolutions, a firing frequency circuit 92 is included in the controller which doubles the firing frequency of the ink ejecting nozzles when the printing resolution is doubled and the rotational speed of the drum 11 remains the same. The controller 54, upon receipt of a higher resolution image signal from the image input device 72, generates a signal determined in part by the firing frequency circuit 92 which is transmitted over the bus 70 to the print bar control circuits 92 where the print bar 10 receives the necessary signals for printing at an increased frequency. If, for instance, the firing frequency of the printhead nozzles is four kilohertz at a printing resolution of 400 spots per inch, then at 800 spots per inch the firing frequency would be set to 8 kilohertz. It is also possible that due to limitations of the print bar for printing at higher frequencies, a speed control circuit 96 operating in conjunction with the firing frequency circuit 94 prints at an increased resolution but at a slower printing throughput. For instance, if the firing frequency is not increased then the speed control circuit 96 generates a signal transmitted to the printer control circuits 82 and to the drum motor 9 such that the drum motor is slowed to one-half of its operating speed when printing at the resolution of the printbar nozzles. It is also possible, for instance, that if the firing frequency of the printhead nozzles can only be increased to one and one-half times the original firing frequency, then the speed control circuit 96 reduces the rotational speed of the drum by a factor of one and one-half times.

The controller 54 further includes a drop size circuit 98 which controls the amount of ink deposited per drop on the recording medium. For instance, at 400 spots per inch, it has been determined that a drop size of approximately 80 to 120 picoliters is necessary to provide acceptable images. To print at 800 drops per inch, however, the drop size may need to be reduced to prevent an excess amount of ink from being deposited on the recording medium. Consequently, once the controller 54 receives the resolution selection from the image input device 72, the drop size circuit 98 transmits a signal over the bus 70 to the print bar 10 to cause the print bar 10 to reduce the amount of ink deposited per drop by each of the nozzles. Drop size reduction can be accomplished by varying the signal levels which are transmitted to each of the transducers in the print bar 10 such that the amount of heat generated by the thermal transducers is reduced to thereby reduce the amount of ink ejected from each of the printhead nozzles. It is also possible that the nozzle size could be reduced to eject an optimum amount of ink selected for 800 spots per inch but the nozzles still being spaced at 400 drops per inch. In this way, a draft mode could be accomplished at 400 drops per inch with the smaller drop size and a standard or high resolution mode would be achieved by the same drop size where the print bar is incrementally stepped one-half the nozzle spacing.

While the various described circuits 80, 90, 96, 94, and 98 have been identified as part of the controller 54, these circuits can be separate from the controller. In addition, the controller 54 as well as the described circuits 80, 90, 96, 94, and 98 can be embodied as hardware, software, or firmware. It is well known and commonplace to program and execute imaging, printing, document, and/or paper handling control functions and logic with software instructions for conventional or general purpose microprocessors. This is taught by various prior patents and commercial products. Such programming or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

While this invention has been described in conjunction with a specific embodiment thereof, in an ink jet environment, it is evident that many alternatives, modifications, and variations will be apparent to those skilled in the art. For instance, the present invention is not limited to the embodiments shown, but is applicable to any type of ink jet printer having a pagewidth print bar. For instance in one practical embodiment of the present invention, the printhead could include roofshooter type of printhead dies, as well as piezolelectric, wax based, and thermal. In addition, the present invention while being described with regards to a rotating drum configuration, is also applicable to a belt type of transport system. Accordingly, it is intended to embrace all such alternatives, modifications and variations that fall within the spirit and broad scope of the appended claims.

What is claimed is:

1. A liquid ink printer, depositing ink drops to form an image, in multiple printing resolutions, on a recording medium moving along a recording medium path, comprising:

a pagewidth printbar, including an array of ink ejecting nozzles spaced at a predetermined resolution, aligned substantially perpendicular to the recording medium path, to eject the ink drops on the recording medium during movement of the recording medium along the recording medium path;

a positioning device, coupled to said pagewidth printbar, to position said printbar at a plurality of discrete locations;

a controller, coupled to said printbar, including a plurality of circuits, to control the interaction of said circuits and thereby cause the printer to print at a resolution greater than a fixed printhead nozzle resolution; and an image input device, coupled to said controller, including a user interface for providing selectable printing resolutions.

2. The liquid ink printer according to claim 1, wherein said controller comprises a resolution circuit, a firing frequency circuit, a drop size modulation circuit, a speed control circuit, and a nozzle selection circuit.

3. The liquid ink printer according to claim 2, wherein said resolution circuit transmits a signal to said positioning device to cause said positioning device to move said pagewidth printbar to enable a printing resolution of greater than the predetermined resolution.

4. The liquid ink printer according to claim 3, wherein said plurality of discrete locations is less than or equal to four, with each of said discrete locations being spaced so that drops are deposited between adjacent ink ejecting nozzles.

5. The liquid ink printer according to claim 4, wherein said plurality of discrete locations is equal to two, with each of said discrete locations being spaced so that the ink drops are deposited between adjacent ink ejecting nozzles.

6. The liquid ink printer according to claim 3, wherein said printing resolution is twice the predetermined resolution.

7. The liquid ink printer according to claim 2, wherein said nozzle selection circuit transmits a nozzle selection signal to said printbar to control which of said ink ejecting nozzles eject ink drops on the recording medium during movement of the recording medium along the recording medium path.

8. The liquid ink printer according to claim 7, wherein said nozzle selection circuit transmits a signal to said printhead to provide for alternating ones of said plurality of ink ejecting nozzles to eject ink during formation of the image.

9. The liquid ink printer according to claim 2, wherein said firing frequency circuit transmits a firing frequency signal to said printbar to control the frequency with which ink is ejected from said array of ink ejecting nozzles on the recording medium.

10. The liquid ink printer according to claim 9, wherein said firing frequency signal comprises a first firing frequency signal to cause said ink ejecting nozzles to eject ink at a first frequency at the predetermined resolution and a second firing frequency signal to cause said ink ejecting nozzles to eject ink at a second frequency at twice the predetermined resolution.

11. The liquid ink printer according to claim 2, wherein said drop size modulation circuit transmits a signal to said printbar to control the size of the ink drops.

12. The liquid ink printer according to claim 11, wherein said drop modulation signal includes a first modulation signal to cause said ink ejecting nozzles to eject a first size of ink drop at said first frequency and a second modulation signal to cause said ink ejecting nozzles to eject a second size of ink drop at said second frequency.

13. The liquid ink printer according to claim 2, wherein said speed control circuit is coupled to said electromover, to transmit a speed control signal to said electromover to control the speed thereof.

14. The liquid ink printer according to claim 13, wherein said speed control circuit comprises a first speed signal to rotate said drum at a first speed to print the image at a first resolution and a second speed signal to rotate said drum at a second speed to print the image at a second resolution.

15. The liquid ink printer according to claim 2, wherein said controller operates said speed control circuit in conjunction with said firing frequency circuit to provide a selectable printer resolution.

16. The liquid ink printer according to claim 1, further comprising a moving device, coupled to said controller, disposed adjacent to said pagewidth printbar, to move the recording medium past said array of nozzles a plurality of times to complete the image.

17. The liquid ink printer according to claim 16, wherein said moving device comprises a rotatable drum, to rotate a plurality of times to complete the image.

18. The liquid ink printer according to claim 17, further comprising a multiple speed electromover, coupled to said rotating drum, to rotate said drum at a plurality of speeds.

19. The liquid ink printer according to claim 16, wherein said moving device comprises a transport belt, to transport the recording medium a plurality of times to complete the image.

20. The liquid ink printer according to claim 1, wherein said image input device comprises a personal computer.

21. The liquid ink printer according to claim 1, wherein said image input device comprises a computer workstation.

22. The liquid ink printer according to claim 1, wherein said image input device comprises a scanner.

* * * * *